United States Patent [19]

Lees et al.

[11] Patent Number: 4,664,789

[45] Date of Patent: May 12, 1987

[54] CLASSIFYING DEVICE

[75] Inventors: Jeremy J. Lees, Birchgrove; Murray H. Pryor, Roseville; John R. G. Andrews, Glen Waverley, all of Australia

[73] Assignee: Minpro Pty. Limited, Rozelle, Australia

[21] Appl. No.: 810,386

[22] PCT Filed: Apr. 15, 1985

[86] PCT No.: PCT/AU85/00080

§ 371 Date: Jan. 8, 1986

§ 102(e) Date: Jan. 8, 1986

[87] PCT Pub. No.: WO85/04600

PCT Pub. Date: Oct. 24, 1985

[30] Foreign Application Priority Data

| | | | |
|---|---|---|---|
| Apr. 13, 1984 | [AU] | Australia | PG4567 |
| May 11, 1984 | [AU] | Australia | PG4937 |
| Nov. 5, 1984 | [AU] | Australia | PG7982 |

[51] Int. Cl.[4] ..... B03B 3/04

[52] U.S. Cl. ..... 209/211; 209/459; 210/322; 210/512.1

[58] Field of Search ..... 209/211, 459, 494, 144; 210/787, 788, 789, 322, 304, 512.1

[56] References Cited

U.S. PATENT DOCUMENTS

| | | | |
|---|---|---|---|
| 2,431,559 | 11/1947 | Humphreys | 209/211 |
| 2,431,560 | 11/1947 | Humphreys | 209/211 |
| 2,700,469 | 1/1955 | Humphreys | 209/211 |
| 3,891,546 | 6/1975 | Humphreys | 209/211 |

FOREIGN PATENT DOCUMENTS

| | | |
|---|---|---|
| 223942 | 2/1950 | Australia . |
| 222329 | 2/1959 | Australia . |

*Primary Examiner*—Frank Sever

*Attorney, Agent, or Firm*—Holman & Stern

[57] ABSTRACT

An hydraulic spiral separator (10), for separating minerals, having at least one substantially helical trough (11) of a cross sectional shape comprising a base portion, an upwardly directed wall portion radially outwardly of the base portion and an upwardly directed lip radially inwardly of the base portion. The characterizing feature is that the wall portion is connected to a plurality of support members (12) positioned radially outwardly of the wall, and the lip is free and unconnected directly to any supporting means, which enables a number of spirals to be stacked coaxially thus saving floor space. Optionally the trough (11) is made of flexible material so that by varying the attachment to the support members (12) the trough may be flexed to change its pitch. Inlet pipes (16), and (18) are fitted as are conventional splitters (19) having moveable vanes (21).

7 Claims, 5 Drawing Figures

CLASSIFYING DEVICE

CROSS REFERENCE TO RELATED APPLICATION(S)

This U.S. application stems from PTC International Application No. PCT/AU85/00080 filed Apr. 15, 1985.

The present invention relates to a spiral separator adapted for separating particles in a stream of such particles according to their respective densities and/or sizes.

Conventionally spiral separators comprise a helical trough normally supported by a central pillar or column, The trough is conventionally of a cross-sectional shape that includes a base portion adjacent the central pillar or column and a wall portion at the radial extremity of the trough. In some cases there is a smooth arcuate transition between the base portion and the wall portion while in other cases there is a clear angular disjunction therebetween. The efficiency of separation of materials according to their density and particle size will depend upon the pitch of the helical trough and to a lesser extent the means used to introduce a slurry onto the trough and the cross-sectional shape of the trough. The splitters used to split the stream flowing off the trough into fractions also contribute to the efficient operation of the spiral separator.

The conventional spiral separators also suffer from a number of disadvantages due to their mode of construction. In the first place for the flange on the radially inner edge of the trough to be effectively connected to the central column, which is normally done with rivets, it is necessary to space the troughs apart sufficiently for an operator to reach between the troughs. This means there is a severe limit to the number of troughs which may be accommodated on one column. The normal number of troughs on a column being two or three. Conventional spiral separators introduce the slurry to be separated vertically donwardly into a feed box from where it flows onto the trough. The depth of the feed box has itself limited the number of troughs which may be nested together. This problem is made worse by the fact that the outer wall of the trough preferably extends upwardly at a steep angle to the horizontal and adjacent troughs are thus in much closer juxtaposition at their outer edges than they are at their points of contact with the column. Secondly it is difficult to obtain access to the troughs from their outer edges if it is desired to wash them clean. Such washing may be required to clear obstructions in a trough or because a different material is to be classified in the spiral separator. Thirdly it can be difficult to accurately position the troughs on the central column. Accurate positioning is necessary to maintain the trough at the desired pitch to bring about the desired separation of the particles in the slurry stream.

The present invention is in a first aspect directed to spiral separators which substantially avoid the above problems and which allow a greater number of troughs to be supported in coaxial array than has previously been possible.

The present invention consists in its first aspect in a spiral separator comprising at least one substantially helical trough having a cross sectional shape comprising a base portion, an upwardly directed wall portion radially outwardly of the base portion and an upwardly directed lip radially inwardly of the base portion, characterised in that the wall portion is connected to one or more support members positioned radially outwardly of the wall, and in that the lip is free and unconnected, directly, to any supporting means, the lip serving to define an axially extending space within the separator.

The troughs and the support members preferably are made from glass reinforced plastic in a suitable mould, however, it will be appreciated that either could be made from other material and in other ways. In particular the support members may be made of extruded aluminium.

It is strongly preferred that the troughs be sufficiently flexible that the pitch thereof may be varied at the time the trough is connected to the support members. The trough is preferably made of a fibre reinforced synthetic plastics material with a maximum thickness of 10 mm. and a preferred thickness of no more than 5 mm. The trough is preferably so formed that the trough may be varied in pitch by an amount of at least 15% of its manufactured pitch and preferably at least 30% of its manufactured pitch. This ability to increase or decrease the pitch at the time of manufacture, or indeed by repositioning the trough at some time after manufacture, allows the spiral separator to be adapted to any particular material to be separated.

The support members are preferably elongate channel section members spaced apart around the circumference of the troughs. Most desirably there are from two to four support members on each spiral separator. Each support member may be formed on its face abutting the troughs with guide means which assist in the accurate positioning of the troughs relative to the support members. The provision of the guide means assists in ensuring that the troughs have the correct pitch throughout their length. It should be noted that the guide means may be positioned to give the troughs constant pitch or a pitch which varies through the height of the spiral separator. It should also be noted that the support members may be designed for attachment to troughs which are not of constant diameter. In an alternative emebodiment of the invention no guide means are provided and holes are drilled or punched in the support member and screws or rivets used to affix the troughs to the support member at the desired pitch.

The spiral separator is preferably used with launder to carry away the product flowing from the troughs. The launder preferably extends tangentially of the spiral separator. In this case the support members are so placed asymmetrically around the spiral separator that they leave the launder free to be removed from beneath the spiral separator.

The arrangement according to the first aspect of the present invention allows for very close juxtaposition of the outer edges of adjacent troughs without interferring with the ease with which the spiral separator may be assembled. This allows a much greater number of troughs to be included in a spiral separator.

It is possible to clean out the spiral separators according to this aspect of the present invention by passing a hose having a nozzle which causes water to project radially outwardly from the hose down the central, axial, passageway defined by the free lips constituting the radially inner edge of the troughs. Notwithstanding the closeness of the juxtaposition of the radially outer side walls of the troughs the radially inner lips may be spaced apart sufficiently for adequate access to the troughs to be obtainable for cleaning purposes.

In a second aspect the present invention consists in a spiral separator having one or more of the following features:

(a) a trough of uniform cross-sectional shape throughout its length, and having a reduction in pitch from an upper revolution of the spiral to a lower revolution of the spiral, (b) an inlet pipe arranged to discharge a stream of a slurry containing particles to be separated onto an upper surface of the trough, which pipe discharges onto the trough substantially tangentially thereof, (c) a splitter or splitters formed separately from the trough itself and spaced slightly from the discharge point of the spiral which splitter may handle the discharge from a plurality of coaxial troughs simultaneously.

If desired the trough for use in this second aspect of the invention may include a concentrate gutter formed in the base portion of the trough adjacent the central pillar or column. This concentration gutter, if present, will be separated from the remainder of the base portion by a low wall which is provided with gaps at spaced apart intervals through which concentrates in the base portion may enter the concentrate gutter. If desired some or all of these gaps may be provided with adjustable splitters to allow a greater or lesser quantity of material from the base portion to be directed into the concentrate gutter.

The spiral separator according to this invention preferably has a trough which is of constant cross-sectional shape along its full length. The cross-sections preferably includes a base portion which extends substantially horizontally from an inner free lip then rises in a linear fashion, or in a long radius curve, relative to the horizontal before curving upwardly into the wall portion which terminates in a substantially vertical section.

The free edge of the wall portion preferably is covered by a plastic, rubber or like moulding. This moulding preferably includes an inwardly directed lip adapted to bear against the underside of another trough nested coaxially with the trough carrying the moulding.

The pitch of the trough may be uniform throughout the length of the spiral, or more preferably, the pitch will reduce as between an upper turn or revolution and a lower turn or revolution in the trough. Most preferably the pitch will reduce gradually through the full length of the trough. It is possible, however, for the pitch to increase before decreasing down the height of the spiral. The exact pitch and the degree of reduction of pitch will vary with the materials to be separated, the average particle size of these materials and the distribution of particle sizes within the material. As has been stated above the troughs are of such a flexibility that the pitch, and any change in pitch, of the spiral may be set at the time the individual spiral separator is manufactured from a standard trough.

The material to be classified, which will normally be in the form of an aqueous slurry, is preferably fed onto the inlet end of the spiral according to this invention through a pipe of a diameter very much smaller than the width of the trough. This pipe preferably extends substantially parallel to the shape of trough at its point of attachment to the trough and substantially tangentially of the trough, or at least of the effective radius of the trough at the point at which the pipe is connected to it. The pipe may alternatively be angled downwardly toward the surface of the trough while extending tangentially thereof.

In many situations the pipe is most advantageously connected to the trough closely adjacent the trough side wall. In alternative embodiments of the invention the pipe may be attached at other points across the radius of the trough. The most desirable point of attachment will depend upon the material being separated on the spiral separator. The pipe is preferably so shaped that it conforms closely to the shape of that part of the trough to which it is attached. The pipe is preferably formed of a flexible synthetic plastics material to facilitate its deformation against the trough. This arrangement provides a smooth laminar flow of the slurry onto the trough with the slurry flowing in the right direction down the trough at the right velocity and without causing undue abrasive wear on the surface of the trough.

The spiral according to this aspect of the invention is such that a plurality of troughs may be nested together coaxially on a single central column. Desirably at least four such troughs, and most preferably up to ten, can be nested together. This provides a very high effective trough density per unit floor area in a treatment plant or factory.

It is a feature of this invention that the spiral separator is preferably provided with a splitter or splitters to divide the stream of slurry flowing from the discharge end of the spiral, or more preferably, of a plurality of such spirals nested coaxially together. The splitter or splitters are preferably spaced slightly from discharge end of the spiral separator or separators but standing free thereof such that the splitter or splitters are not contacted by the slurry until a short distance after it has been discharged from the spiral or spirals. The distance between the end of each trough and the adjacent edge of each splitter should be at least twice the maximum diameter of the largest sized particles expected to be encountered on the spiral separator. The spacing of the splitters from the end of the trough prevents the separator becoming blocked by large size particles or extraneous material such as grass becoming jambed on the splitter vane as happens with conventional splitters. The distance of separation of the end of each trough from the closest adjacent edge of the or each vane is from 5 to 50 mm, preferably 10 to 15 mm.

The splitter or splitters preferably each comprise a vertically arranged vane adapted to be pivotably adjustable about a vertical axis. Preferably the splitters discharge directly into a substantially horizontally extending launder adapted to receive the discharge from an array of separate spiral separators each including a plurality of nested troughs.

Hereinafter described by way of example only is a preferred embodiment of the present invention described with reference to the accompanying drawings in which.

Figure 5:
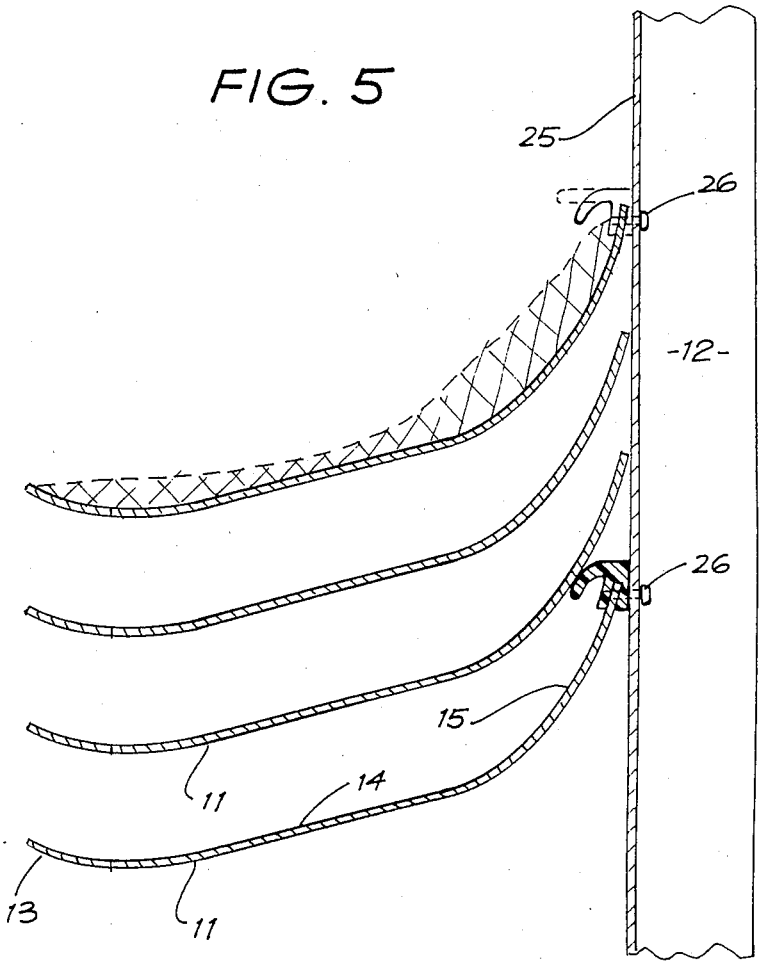
FIG. 5 is a detailed vertical sectional view of the spiral separator of FIG. 1 showing the cross-sectional shape of the troughs thereof.

The spiral separator 10 includes four nested and coaxial troughs 11 each riveted to a plurality of supporting legs 12. Each of the troughs, as is seen in FIG. 5, includes an inner flange 13, a base part 14 and a side wall 15. The troughs 11 are all of a constant cross-sectional shape throughout their length.

A slurry, such as a slurry of fine coal particles, is fed onto the spirals 10 through flexible plastic pipes 16. The pipe 16 is of larger diameter than a slurry feed pipe 18 bringing slurry to the spiral separator 10. Each pipe 16 is clamped to its associated trough 11 with a metal clamp 17. The pipe 16 is made of a flexible synthetic plastic material such that its cross-sectional shape may be modified by the clamp 17 the conform to the shape of the trough 11 against which the pipe 16 is clamped and provides a preformed stream cross section. The pipes 16 are each held closely against the active surface of the trough 11 and extend substantially tangentially therefrom. In this way the slurry is discharged with minimum turbulence and wear down the trough 11.

Figure 1:
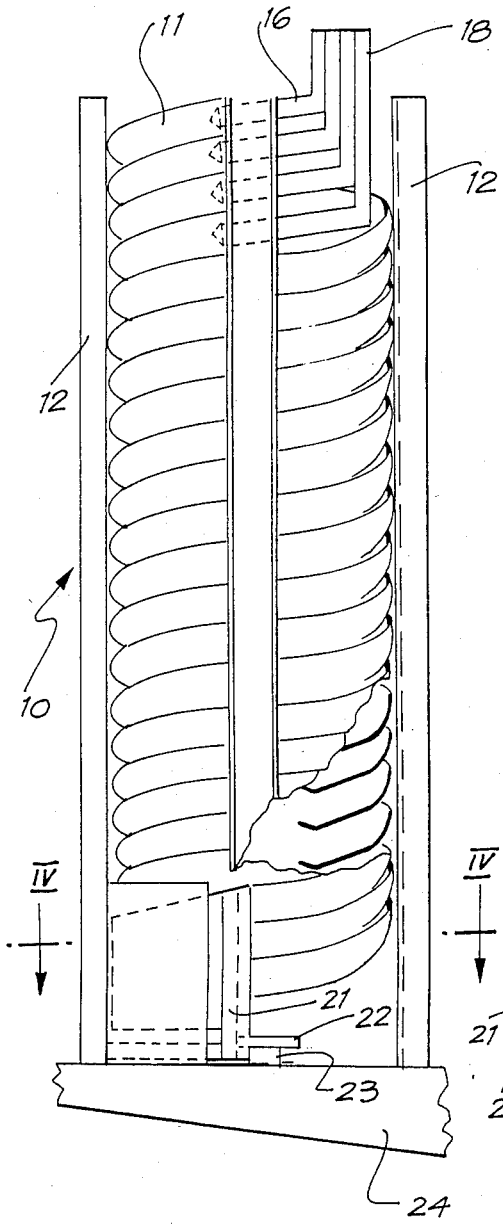
FIG. 1 is a partly cut away side elevational view from direction A of FIG. 3 of a four start, five turn, spiral separator according to the first aspect of this invention.
Figure 2:
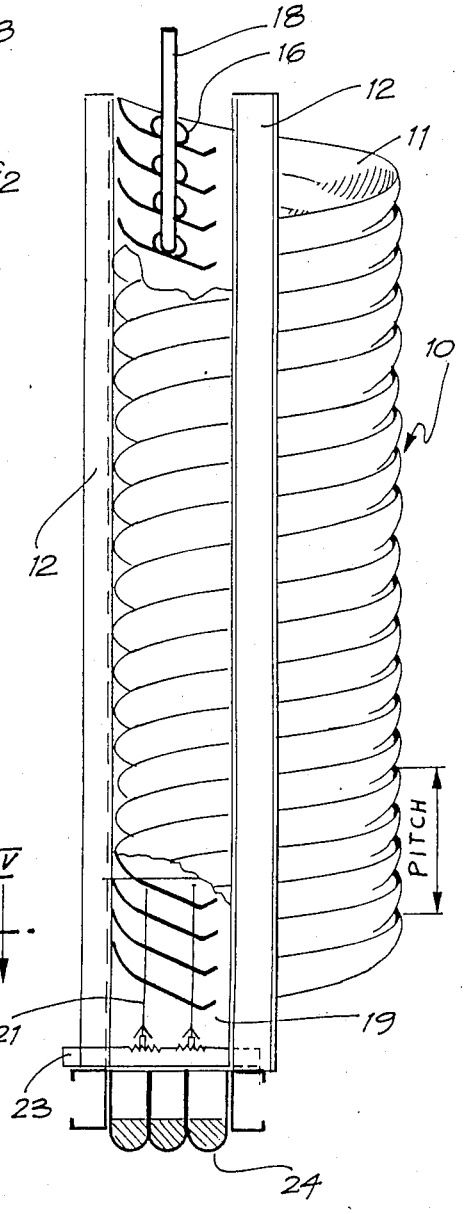
FIG. 2 is a partly cut away side elevational view from direction B of FIG. 3 of the spiral separation of FIG. 1.
Figure 3:
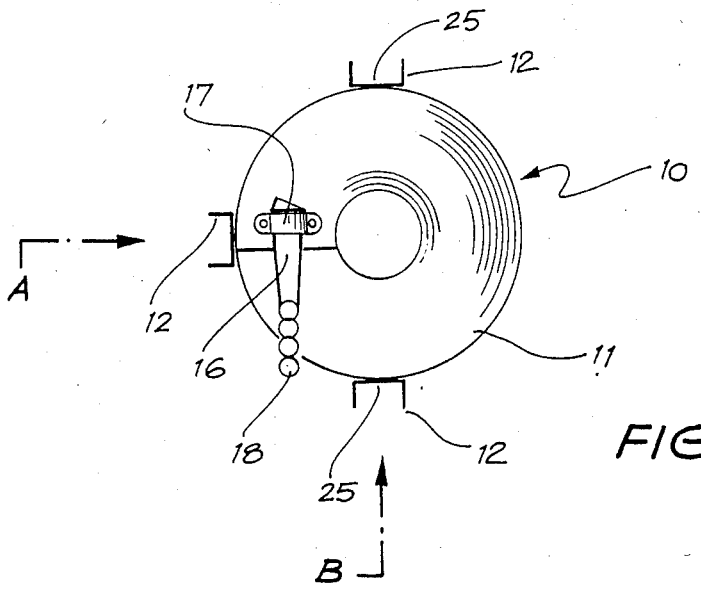
FIG. 3 is a plan view of the spiral separator of FIG. 1.
Figure 4:
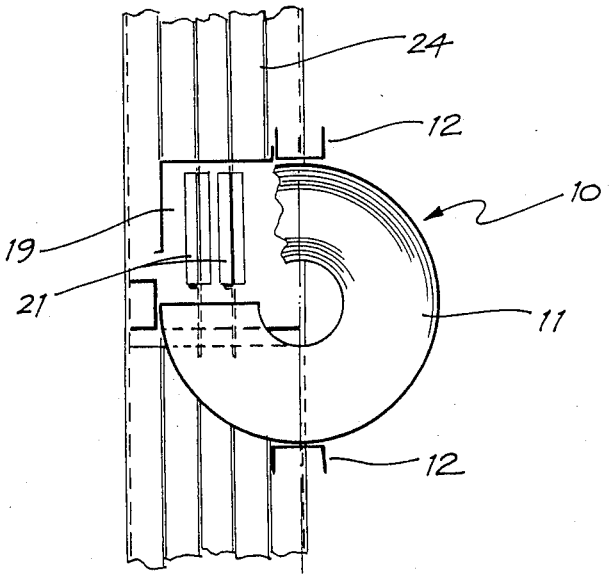
FIG. 4 is a sectional view of the spiral separator along IV—IV of FIG. 1.

The pitch of the troughs 11 may be constant or may vary as in FIGS. 1 and 2. In the latter case there is preferably a section of each trough 11 in which the pitch decreases, this section is most preferably adjacent the bottom of the column. As is seen in FIG. 2 the pitch may in fact increase as one descends the upper end of the column.

The troughs 11 all discharge into a separate common splitter box 19 arranged adjacent the discharge end of the troughs 11. The splitter box 19 includes a pair of vertically mounted straight vanes 21. Each vane is pivotable about a vertical axis to allow an adjustment of the cut of the slurry off the spiral into a concentrator, middlings and tailings. Each vane 21 includes on its leading edge adjacent the bottom thereof an adjustment arm 22. The lower edge of the arm 22 bears on a serrated location bar 23. Movement of the arm 22 about the axis of rotation of the vane 21 adjusts the relative position of the vane 21. The vane 21 is maintained in a desired location by engagement of the arm 22 in an appropriate serration in the location bar 23. The splitter box may discharge into, or incorporate, launders 24 joining one set of spirals to adjacent spirals without the use of piping.

Each of the support members 12 is of channel section, the base 25 of the support member 12 constituting a face adapted to bear against the radially outer surface of the outer walls 15 of the trough 11. The troughs 11 are connected to the support members 12 by rivets or screws 26 which extend through holes in the base 25 of the support member 12 and holes 21 in the side walls 15 of troughs 11. If it were desired to change the pitch of the troughs the screws 26 may be unscrewed or otherwise removed and the troughs re-screwed onto the support members in a new pitch configuration. The change of pitch is facilitated by the troughs being made of a very thin fibreglass material and having no thick flanges resisting compression or expansion of the pitch of the trough as it comes from the manufacturing mould.

It can be seen that while the radially outer side walls 15 of the troughs 11 are maintained in very close juxtaposition the radially inner lips 13 are quite widely spaced apart. Thus even though the spiral separator 10 may include up to ten troughs 11, rather than the conventional two or three troughs, it is still possible to assemble the spiral separator 10 and to clean it out if necessary.

We claim:

1. A spiral separator, comprising:

a plurality of vertically extending support members adapted to support at least four substantially helical troughs in a single column, each trough having a cross-sectional shape including a base portion, an upwardly directed wall portion radially outwardly of the base portion, and an upwardly directed lip radially inwardly of the base portion, the wall portion of each trough being connected to the support members which are positioned radially outwardly of the wall portion, and in spaced-apart array, by a fastener means;

the lips of the troughs serving to define an axially extending space within the troughs of sufficient size to allow access to the troughs for washing;

each trough being formed of a glass reinforced plastics material and being of sufficient flexibility that the pitch thereof is determined at the time of construction of the spiral separator by the accurate position of the fastener means connecting the trough to the support members.

2. A spiral separator as claimed in claim 1 in which each support member comprises an elongate channel section member and in which a plurality of such support members are spaced about the circumference of the trough or troughs.

3. A spiral separator as claimed in claim 1 in which guide means are positioned on the face of each support member abutting the troughs to assist in the accurate positioning of the trough or troughs relative to the support member or members.

4. A spiral separator as claimed in claim 1 in which each trough is of a uniform cross-sectional shape throughout its length and has a reduction in pitch from an upper revolution of the spiral to a lower revolution thereof.

5. A spiral separator as claimed in claim 1 in which the spiral separator includes an inlet pipe arranged to discharge a stream of a slurry containing particles to be separated onto an upper surface of the, or a, trough which pipe discharges onto the trough substantially tangentially thereof.

6. A spiral separator as claimed in claim 1 in which the spiral separator includes and at least one splitter spaced slightly from the discharge point of the troughs, each splitter comprising a vertically extending blade pivotable about a vertical axis, each blade serving to split the discharge from all of the troughs simultaneously.

7. A spiral separator as claimed in claim 1 in which the radially outer free edge of each trough is provided with a moulding which includes an inwardly directed lip adapted to bear against the underside of another trough nested coaxially with the trough carrying the moulding.

* * * * *